United States Patent [19]

Frank et al.

[11] Patent Number: 4,756,936

[45] Date of Patent: Jul. 12, 1988

[54] TREETOP ORNAMENT HOLDER

[76] Inventors: Arnold Frank; Richard Tibak, both of c/o Bradford Novelty Co., 451 D St., Boston, Mass. 02110

[21] Appl. No.: 45,313

[22] Filed: May 4, 1987

[51] Int. Cl.[4] ..... A47G 33/08

[52] U.S. Cl. ..... 428/7; 428/19

[58] Field of Search ..... 428/7, 8, 18, 19, 20, 428/28

[56] References Cited

U.S. PATENT DOCUMENTS

| | | | |
|---|---|---|---|
| 3,867,237 | 2/1975 | Kearney | 428/20 |
| 4,214,023 | 7/1980 | Day | 428/102 X |
| 4,428,988 | 1/1984 | Adinamis | 428/20 X |
| 4,526,819 | 7/1985 | Murray | 428/19 X |

*Primary Examiner*—Henry F. Epstein

*Attorney, Agent, or Firm*—Wolf, Greenfield & Sacks

[57] ABSTRACT

A treetop ornament holder comprising an upper body portion simulating the shape of the upper end of the trunk of a tree; the upper body portion having a hollow cavity and comprising a tubular shaped upper tip mechanism and an aperture at the lower end of the upper body leading into the cavity; the upper tip mechanism including an aperture therethrough for receiving the mounting stem of a treetop ornament; a relatively long lower body portion integrally formed at its upper end together with the lower end of the upper body portion; the lower body portion extending downwardly and comprising an extended tubular shaped sidewall forming a cavity for receiving the upper end of the trunk of the treetop and allowing the extended sidewall to surround the outside surface of the upper end of the trunk of the treetop; the inside surface of the extended sidewall forming a continuous elongated surface leading into the cavity; and, a mechanism connected to the extended sidewall for frictionally engaging around the outside surfaces of the upper end of the tree trunk and securing the ornament holder thereto.

7 Claims, 1 Drawing Sheet

TREETOP ORNAMENT HOLDER

BACKGROUND OF THE INVENTION

The present invention relates to tree ornament holding devices and in particular to a device which may be employed to lengthen the top end of a tree trunk and act as a holder for a treetop ornament.

The upper tip ends of the trunks of house plants or Christmas trees are often lower in height than one or more branches which extend laterally from the upper portion of the trunk and thus are not ideally suited for placing a treetop ornament thereon because the one or more branches surrounding the tip end of the trunk often hide the treetop ornament from view. The upper tip ends of such trees and plants are also very often so flimsy that they are unable to support the weight of an average sized treetop ornament.

It is an object of the invention therefore to provide a treetop holder which can be readily placed on or around the upper tip end of the trunk of a tree and simultaneously act to extend the length of the trunk of the treetop, if necessary, and to fortify the strength thereof.

SUMMARY OF THE INVENTION

In accordance with the invention there is provided a treetop ornament holder comprising: an upper body portion simulating the shape of the upper end of the trunk of a tree; the upper body portion having a hollow cavity and comprising a tubular shaped upper tip mechanism and a rounded aperture at the lower end of said upper body leading into the cavity; the upper tip mechanism including an aperture therethrough for receiving the mounting stem of a treetop ornament; a relatively long lower body portion integrally formed at its upper end with the lower end of the upper body portion; the lower body portion extending downwardly and comprising an extended tubular shaped sidewall forming a cavity for receiving the upper end of the trunk of the treetop and allowing the extended sidewall to surround the outside surface of the upper end of the trunk of said treetop; the inside surface of the extende sidewall forming a continuous elongated surface leading into the cavity; and a mechanism connected to the extended sidewall for frictionally grasping the outside surfaces of the upper end of the tree trunk and securing the ornament holder thereto.

The lower body portion preferably comprises an axially sectioned tubular wall section having an inside diameter at least as large as the outside diameter of the upper portion of the tree trunk. The cavity typically comprises an upper conically shaped cavity portion and a lower tubular shaped cavity portion.

The upper tip mechanism comprises a short tubular shaped section having a tubular aperture therethrough communicating with the upper cavity portion. The upper body portion and the lower body portion preferably form a unitary rigid plastic body. The ornament holder most preferably includes an independent lower body section for extending the axial length of the integrally formed lower body portion.

The independent lower body extension section typically comprises an extended axially sectioned tubular wall section having a sleeve portion integrally formed together with the top end of the extended tubular wall section, the sleeve portion comprising a relatively short axially sectioned tube having an inside diameter approximately equal to the outside diameter of the tubular lower body portion of the unitary rigid body and wherein the sectioned ends of the sleeve portion include fingers protruding inwardly toward the tubular cavity of the sleeve portion for slidably engaging the outside sectioned edges of the sectioned tubular sidewall of the lower body portion of the rigid unitary body. Typically, the upper body portion has an axial length of between about 1.5 and about 3.5 inches and the lower body portion has an axial length of at least about 3 inches.

DETAILED DESCRIPTION OF PREFERRED EMBODIMENTS

Figure 1:
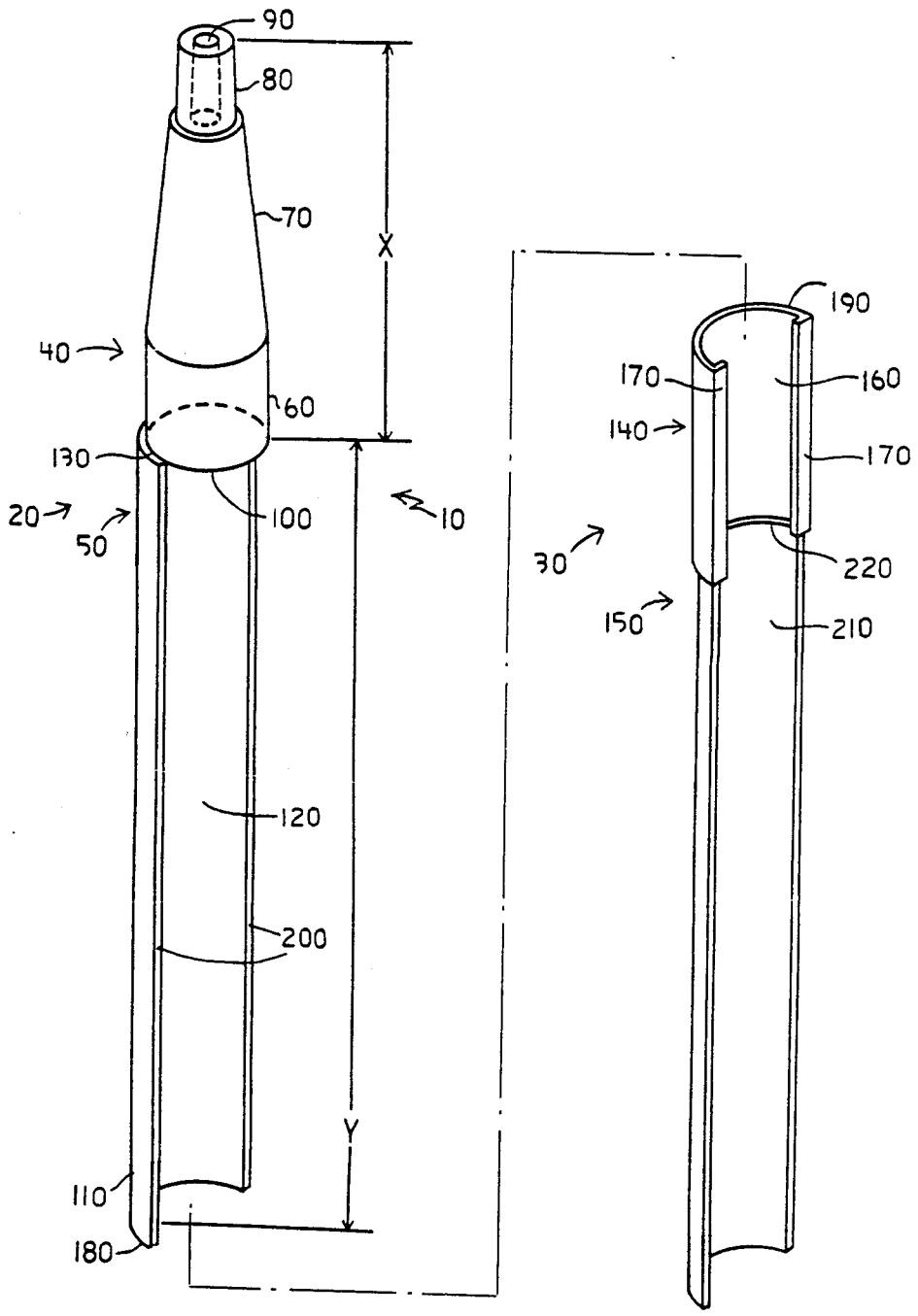
FIG. 1 is a side isometric view of a treetop ornament holder according to the invention showing a upper unitary holding structure and a lower unitary extension structure therefor.

Following is a description of a most preferred embodiment of the invention.

With reference to FIG. 1 there is shown a treetop ornament holder 10 comprising a unitary rigid holding structure 20 and an independent lower extension structure 30. The unitary structure 20 comprises an upper body portion 40 and a lower body portion 50. The upper body 40 comprises a generally cylindrical section 60, a conically shaped section 70 and a tubular tip section 80. The tip 80 typically includes an axially centered aperture 90 which leads into and communicates with a hollow cavity provided in the conically shaped section 70. The cylindrical section 60 is also typically hollow thus forming a continuous hollow cavity throughout sections 60, 70 and 80.

The bottom end of section 60 typically forms a rounded aperture 100 which may be utilized to receive therethrough the top end of a tree trunk or the top end of the dowel (trunk) of an artificial tree such as a Christmas tree.

A relatively long axially sectioned tubular side wall 110 typically forms the lower body portion 50. The sidewall 110 has a curved inner cavity 120 which, in cross-section, has a shape which is an arc of circle having a diameter at least as great as the widest diameter of the upper portion of the trunk of the treetop to which the sidewall is to be attached. The face of the curved inner cavity 120 is typically emplaced around the outside surface of the top end of the tree trunk and strapped thereto by conventional means such as wire, rope, or cloth or elastic bands (not shown). The bands are preferably tied or otherwise attached to the outside face of the sidewall 110 and have, for example, free ends which may extend therearound and are subsequently tied around the outside surface of the top of the tree trunk.

Where reference is made herein to the diameter of an axially sectioned tube or tubular wall section such as structures 110, 140 or 150, the term diameter refers to a diameter of a circular cross section of such structure as if such structure were not sectioned but rather were a complete tube.

The entire structure 40, 50 is typically constructed out of a rigid plastic material as a single unitary structure such as by injection molding or other conventional methods for producing unitary plastic structures. The structures 40, 50 can be constructed of other rigid materials such as wood, metal and the like but such materials are less preferred due to their inherent higher densities.

Although sidewall 110 may be separately manufactured apart from structure 40 and permanently attached to the lower tip 130 portion of section 60, by heat sealing, adhesive attachment or the like, the top end of sidewall 110 is most preferably integrally formed together with section 60 such that sidewall 110 and section 60 form a unitary rigid structure as a whole, FIG. 1.

Inasmuch as sidewall 110 has some thickness, the cross-sectional diameter of sidewall 110 as measured from the inside face of cavity 120 will be slightly larger than the cross-sectional diameter of sidewall 110 as measured from the outside face thereof. The cross-sectional diameter of sidewall 110 as measured from the face of cavity 120 is most preferably at least as great as the diameter of the widest portion of the top end of the tree trunk which is emplaced within cavity 120, FIG. 1.

The extension section 30 comprises a sleeve section 140 and an extended axially sectioned tubular sidewall section 150, FIG. 1. Similar to the upper 40 and lower 50 sections of body 20, sleeve 140 and sectioned wall section 150 are preferably constructed as a unitary rigid plastic body 30.

The sleeve 140 itself forms a shortened axially sectioned tubular wall section having a cavity 160 which has a diameter as measured from the inside face of cavity 160 which is approximately equal to the diameter of sidewall 110 as measured from the outside surface thereof such that the outside surface of sidewall 110 may be emplaced within cavity and mate with the inside surface of cavity 160, FIG. 1.

The sleeve 140 typically includes fingers 170 which protrude inwardly toward the cross-sectioned center of cavity 160. The axial length Y of sidewall 110 may be extended by use of body 30 by inserting the bottom edge 180 of sidewall 110 downwardly into cavity 160 through the top rim 190 of sleeve 140. Once the bottom edge 180 is inserted downwardly into cavity 160 through the top rim 190, the sectioned edges 200 of sidewall 110 abut the inside surfaces of fingers 170 and sidewall 110 is thus encased within sleeve 140. The outside circumferential length of sidewall 110 (i.e. the length of the arc formed by the outside surface of sidewall 110 in cross-section) is most preferably selected to be approximately equal to the inside circumferential length of the face of cavity 160 (i.e. the length of the arc formed by the inside surface of cavity 160 in cross-section) which terminates at its sectioned edges at the inside surfaces of fingers 170. In such a most preferred embodiment, the bottom portion of sidewall 110 thus fits within cavity 160 after being inserted therein without rotational slippage, FIG. 1.

The diameter of wall section 150 as measured from the inside surface 210 thereof is typically approximately equal to the inside diameter of cavity 120. The inside diameter of section 150 is thus typically less than the diameter of cavity 160 thus forming a small ridge 220 on which the bottom edge 180 of sidewall 110 may sit once fully inserted within cavity 160.

Sidewall 110 is preferably attached to or integrally formed together with body portion 40 such that the inside surface of cavity 120 forms a continuous smooth surface with the inside surface of the hollow cavity in section 60, FIG. 1. Such a continuous smooth surface allows the ready positioning of the top end of a tree trunk within cavity 120 and the ready guiding of the tip of the tree trunk into the hollow cavity of section 60 if necessary.

The axial length Y of sidewall 110, FIG. 1, is typically at least about 3 inches and the axial length X of body portion 40 is typically less than about 3.5 inches. The tip end of a tree trunk may or may not be inserted into the hollow cavity of section 60 and/or section 70 depending on how high the tip end 80 of the tree trunk is to be extended above the branches of the tree via attachment of the holder 10 to the trunk at a selected position near the top end of the tree trunk. In some instances, the user may choose to strap or attach sidewall 110 or wall section 150 to a position near the top end of the tree trunk such that the tip end of the tree trunk either penetrates into the cavity of both sections 60 and 70, or penetrates only into the cavity of section 60 or does not penetrate into either of the cavities of sections 60 or 70.

As described above with reference to sidewall 110, wall section 150 of element 30, when needed, is typically provided with a mechanism for attaching element 30 to the top end of the tree trunk of a tree such as wire, rope, cloth or elastic bands which are most preferably attached to the outside surface of wall section 150 and, for example, have free ends which may be wrapped around the outside diameter of the tree trunk and tied or otherwise attached together in order to effectively strap body 30 (and 40) to the tree trunk.

As can be seen from FIG. 1, when one or both of sidewall 110 and wall section 150 are attached to the outside surface of a relatively flimsy top end of a tree trunk, the lower axial end of wall 110 (or 150) will extend downwardly to surround a more rigid portion of the trunk and, by virtue of the concomitant rigidity of walls 110 and/or 150 (and the rigidity of structures 30 and/or 40 generally) will act to rigidify the top end of the tree trunk such that an average sized (or even a relatively heavy) treetop ornament may be placed on tip structure 80 without the top end of the tree trunk bending under the weight of the treetop ornament.

The specific geometrical shapes of sections 60 and 70 are preferably selected as shown in FIG. 1 in order to simulate the tip end of a tree trunk. Sections 60 and 70 may be constructed in other geometrical shapes however, most preferably in a shape which simulates the top end of a tree trunk. For example, sections 60 and 70 may be merged into a more continuous, more geometrically unitary structure such as a continuous unitary conical shape or bullet shape or the like.

The aperture 90 in tip 80 is shown, for example, in FIG. 1 as cylindrical. Aperture 90 may be configured in any of a variety of forms however, preferably in such a form as to be compatible with the shape/geometry of the mounting structure provided on the ornament which is preselected for mounting on the tip 80.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A treetop ornament holder comprising:

an upper body portion simulating the shape of the upper end of the trunk of a tree;

said upper body portion having a hollow cavity and comprising a tubular shaped upper tip means and an aperture at the lower end of said upper body leading into said cavity;

said upper tip means including an aperture therethrough for receiving the mounting stem of a treetop ornament;

a relatively long lower body portion integrally formed at its upper end together with the lower end of said upper body portion;

said lower body portion extending downwardly and comprising an extended tubular shaped sidewall forming a cavity for receiving said upper end of said trunk of said treetop and allowing said extended sidewall to surround the outside surface of said upper end of said trunk of said treetop;

the inside surface of said extended sidewall forming a continuous elongated surface leading into said cavity;

means connected to said extended sidewall for frictionally engaging around the outside surfaces of said upper end of said tree trunk and securing said ornament holder thereto.

2. An ornament holder according to claim 1 wherein said lower body portion comprises an axially sectioned tubular wall section having an inside diameter at least as large as the outside diameter of said upper end of said tree trunk.

3. An ornament holder according to claim 2 wherein said cavity comprises an upper conically shaped cavity portion and a lower tubular shaped cavity portion.

4. An ornament holder according to claim 3 wherein said upper tip means comprises a short tubular shaped section having a tubular aperture therethrough communicating with said upper cavity portion.

5. An ornament holder according to claim 4 wherein said holder further comprises a rigid unitary plastic body.

6. An ornament holder according to claim 5 further comprising an independent lower body section for extending the axial length of said integrally formed lower body portion.

7. An ornament holder according to claim 6 wherein said independent lower body extension section comprises an extended axially sectioned tubular wall section having a sleeve portion integrally formed together with the top end of said extended tubular wall section, said sleeve portion comprising a short axially sectioned tube having an inside diameter approximately equal to the outside diameter of said tubular lower body portion of said unitary rigid body and wherein the sectioned ends of said sleeve portion include fingers protruding inwardly toward the tubular cavity of said sleeve portion for slidably engaging the outside sectioned edges of said sectioned tubular sidewall of said lower body portion of said rigid unitary body.

* * * * *